US008733421B2

(12) United States Patent
Hirai et al.

(10) Patent No.: US 8,733,421 B2
(45) Date of Patent: May 27, 2014

(54) EVAPORATIVE PATTERN CASTING PROCESS

(75) Inventors: Fumio Hirai, Tochigi (JP); Osami Ito, Tochigi (JP); Hiroyuki Yamada, Tochigi (JP); Hiroshi Ichikawa, Tochigi (JP); Hidetaka Hokazono, Tochigi (JP); Tomohiko Yamamoto, Singburi (TH); Kosuke Murai, Singburi (TH)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/512,130

(22) PCT Filed: Nov. 25, 2010

(86) PCT No.: PCT/JP2010/070997

§ 371 (c)(1),
(2), (4) Date: May 25, 2012

(87) PCT Pub. No.: WO2011/065410

PCT Pub. Date: Jun. 3, 2011

(65) Prior Publication Data

US 2012/0273151 A1 Nov. 1, 2012

(30) Foreign Application Priority Data

| | | |
|---|---|---|
| Nov. 26, 2009 | (JP) | 2009-268629 |
| Nov. 26, 2009 | (JP) | 2009-268633 |
| Nov. 26, 2009 | (JP) | 2009-268704 |
| Nov. 26, 2009 | (JP) | 2009-268748 |

(51) Int. Cl.
*B22C 9/04* (2006.01)

(52) U.S. Cl.
USPC ..... 164/34

(58) Field of Classification Search
USPC ..... 164/34, 35, 45
See application file for complete search history.

(56) References Cited

U.S. PATENT DOCUMENTS

| | | | |
|---|---|---|---|
| 2004/0060681 | A1 | 4/2004 | Nakai et al. |
| 2004/0244934 | A1 | 12/2004 | Narushima et al. |

FOREIGN PATENT DOCUMENTS

| | | | | |
|---|---|---|---|---|
| JP | 63-264243 | | 11/1988 | |
| JP | 03-027842 | | 2/1991 | |
| JP | 07-308734 | | 11/1995 | |
| JP | 11-090583 | | 4/1999 | |
| JP | 2003-001377 | | 1/2003 | |
| JP | 2003-340547 | | 12/2003 | |
| JP | 2003-340547 | A * | 12/2003 | ..... B22C 9/04 |
| JP | 2009-166105 | | 7/2009 | |

OTHER PUBLICATIONS

Machine translation of JP 2003-340547 A.*

* cited by examiner

*Primary Examiner* — Kevin P Kerns
(74) *Attorney, Agent, or Firm* — Rankin, Hill & Clark LLP

(57) ABSTRACT

An evaporative pattern casting process includes forming a mold by burying a pattern made of resin foam in casting sand, pouring molten metal into the mold, and evaporating the pattern with the molten metal and thereby casting a product. In the evaporative pattern casting process, casting time during founding is set according to a modulus (pattern volume÷pattern surface area) of the pattern. Accordingly, the casting time in the evaporative pattern casting process is accurately set with high precision.

3 Claims, 6 Drawing Sheets

[First model]

| | |
|---|---|
| Pattern surface area | S |
| Pattern volume | V |
| Wall thickness | w |
| Amount of gas passing through a pattern per unit time | a·S |
| Modulus | V/S |

[Second model]

| | |
|---|---|
| Pattern surface area | S/2 |
| Pattern volume | V |
| Wall thickness | 2w |
| Amount of gas passing through a pattern per unit time | a·S/2 |
| Modulus | 2V/S |

EVAPORATIVE PATTERN CASTING PROCESS

FIELD OF THE INVENTION

The present invention relates to an evaporative pattern casting process.

DESCRIPTION OF RELATED ART

The following evaporative pattern casting process is generally known. In this process, a mold is formed in such a way that a pattern consisting of resin foam with a predetermined shape is buried in casting sand. Then, molten metal is poured into the mold, whereby the pattern is combusted and evaporated and is replaced with a casting. In regard to this process, a method of calculating appropriate casting time is disclosed in Japanese Unexamined Patent Application Laid-open No. 2003-340547. In this method, the casting time is calculated based on a ratio of casting time when molten metal is poured into a hollow space to casting time during the evaporative pattern casting process.

In the evaporative pattern casting process, the temperature of the molten metal poured into the mold is decreased. Therefore, there may be cases in which residue defects result. In this case, the pattern remains unevaporized specifically at a last poured portion, and the remaining pattern adheres to the surface of a product. In general, molten metal is introduced into a pattern from the bottom up, whereby residue defects tend to occur on an upper surface of a casting product. In view of this, a method of providing an upper and a lower runner for preventing turbulent flow of molten metal is disclosed in Japanese Unexamined Patent Application Laid-open No. 7-308734. According to this method, the molten metal at high temperature rapidly reaches a top portion of a pattern.

In the evaporative pattern casting process, the pattern in the mold is combusted when the molten metal is first poured, whereby an enormous amount of combustion gas is generated and is discharged through the mold to the outside. The generated combustion gas increases pressure (internal pressure) in the mold. If the increased pressure exceeds head pressure of the molten metal, blowback and casting defects may occur. The blowback is blowout of the molten metal from a sprue. The casting defects are residue defects due to the pattern that remained uncombusted because pouring time was prolonged. Therefore, it is required to smoothly discharge the combustion gas to the outside of the mold. In regard to this, techniques for improving discharging efficiency of the combustion gas are disclosed in Japanese Unexamined Patent Applications Laid-open Nos. 2002-219552 and 2003-001377. In the former technique, a pattern is formed with a through hole, and the through hole is made so as to communicate with both a gas discharge passage and a runner provided in a mold. In the latter technique, a discharge passage communicating with the atmosphere is provided to a pattern. On the other hand, in a case of casting a product of approximately 2 to 10 tons, that is, a product having a large modulus (pattern volume÷pattern surface area) of a pattern, combustion gas is explosively generated during initial pouring of molten metal. Therefore, according to the technique disclosed in Japanese Unexamined Patent Application Laid-open No. 2003-001377, the molten metal may go through a filter provided at the discharge passage and may be blown out. In view of this, a hollow space for discharging the combustion gas may be provided within a mold (see Japanese Unexamined Patent Application Laid-open No. 2009-166105, for example). In this case, the combustion gas is discharged without blowing out of the molten metal.

DISCLOSURE OF THE INVENTION

In the evaporative pattern casting process, according to increase in the modulus, the discharging efficiency of the combustion gas, which is generated by combustion of a pattern, to the outside of a mold, is decreased. Therefore, the casting time in the evaporative pattern casting process has different characteristics from the casting time when molten metal is poured into a hollow space. Accordingly, when a modulus is different, the casting time when molten metal is poured into a hollow space is not proportional to the casting time during the evaporative pattern casting process. In view of this, it is required to provide an accurate and high precise method for setting casting time in the evaporative pattern casting process. Accordingly, an object of the present invention is to provide an evaporative pattern casting process by which casting time is accurately set with high precision.

In the method disclosed in Japanese Unexamined Patent Application Laid-open No. 7-308734, according to increase in the number of the runners, the number of the gates is also increased. Therefore, steps of forming a mold and steps of cutting the gates for obtaining a product after the casting are increased, whereby the workability is decreased, and the processing cost is increased. Accordingly, another object of the present invention is to provide an evaporative pattern casting process, in which molten metal at high temperature is filled into the whole area of a pattern without increasing the number of gates, and by which residue defects are effectively reduced.

In the technique disclosed in Japanese Unexamined Patent Application Laid-open No. 2002-219552, a step of forming the through hole in the pattern is complicated and increases the production steps. In this method, by setting high head pressure, blowback of molten metal from a sprue is prevented, whereas the yield ratio is decreased and the production cost is increased. Accordingly, another object of the present invention is to provide an evaporative pattern casting process, which is easy and does not increase the production steps and the production cost, and by which blowback of molten metal from a sprue is reliably prevented.

In the invention disclosed in Japanese Unexamined Patent Application Laid-open No. 2009-166105, an internal space of a tubular member 10 is provided as the hollow space. This hollow space has an upper end that is positioned higher than an upper surface of the uppermost portion of a pattern. In such a mold structure, in order to reliably discharge the combustion gas to the hollow space, a sprue must be positioned high so as to correspondingly increase the head pressure. Since the increase of the sprue height increases the height of the entirety of the mold, the amount of casting sand is increased, and the production cost is increased. Therefore, there is a requirement to lower the sprue height as much as possible. Accordingly, another object of the present invention is to provide an evaporative pattern casting process in which a hollow space for discharging combustion gas is provided within a mold so that head pressure is minimized and sprue height is lowered as much as possible.

The present invention provides an evaporative pattern casting process including forming a mold by burying a pattern made of resin foam in casting sand. This process also includes pouring molten metal into the mold and evaporating the pattern with the molten metal and thereby casting a product. In this process, casting time during founding is set according to a modulus (pattern volume÷pattern surface area) of the pattern.

In further accordance with the present invention, the casting time is calculated from the following First Formula.

First Formula $$t=(W/A')/(\rho\cdot a\cdot m^{-b}\cdot\sqrt{2gH'}) \quad (1)$$

t: casting time (s)
W: pouring weight (kg)
A': sprue area ($cm^2$)
ρ: density of molten metal ($g/cm^{-3}$)
a, b: constants
m: modulus (pattern volume÷pattern surface area)
g: gravity acceleration
H': height from a sprue to an upper end of a pattern (cm)

In further accordance with the present invention the process further includes estimating existence of casting defects based on a difference between the casting time calculated from the First Formula and casting time during practical founding.

In further accordance with the present invention the process further including performing a casting simulation based on the casting time calculated from the First Formula.

The present invention also provides an evaporative pattern casting process including forming a mold by burying a pattern made of resin foam in casting sand. This process also includes pouring molten metal into the mold and evaporating the pattern with the molten metal and thereby casting a product. In this process, a gate for introducing the molten metal into the pattern is arranged in the casting sand at the level of center of gravity of the product.

The present invention also provides an evaporative pattern casting process including forming a mold by burying a pattern made of resin foam in casting sand. This process also includes pouring molten metal into the mold and evaporating the pattern with the molten metal and thereby casting a product. In this process, a gate for introducing the molten metal into the pattern is arranged in the casting sand at the level of from center of gravity of the product down to 120 mm.

The present invention also provides an evaporative pattern casting process including forming a mold by burying a pattern made of resin foam in casting sand. This process also includes pouring molten metal into the mold and evaporating the pattern with the molten metal and thereby casting a product. In this process, when the center of gravity of the product is positioned in a range from a lower end of the product up to 440 mm, a gate for introducing the molten metal into the pattern is arranged in the casting sand at the level of the range so as to be higher than the center of gravity of the product.

In further accordance with the present invention the product is a press die.

The present invention provides an evaporative pattern casting process including forming a mold by burying a pattern made of resin foam in casting sand. This process also includes pouring molten metal into the mold and evaporating the pattern with the molten metal and thereby casting a product. In this process, the mold is formed with a gas discharge passage, and the gas discharge passage is arranged with a filter. The filter has a gas passing sectional area which is set according to a modulus (product volume÷product surface area) of the product. In this case, the product volume and the product surface area are equivalent to the pattern volume and the pattern surface area, respectively. In this invention, combustion gas is generated in the mold while the pattern is evaporated by pouring of the molten metal. The combustion gas enters the gas discharge passage and goes through the filter arranged at the gas discharge passage, to the atmosphere outside of the mold. Some of the combustion gas is discharged through the casting sand to the atmosphere. According to this invention, by setting the gas passing sectional area of the filter according to the modulus, the amount of the combustion gas passing through the filter is appropriately adjusted. As a result, increase of the internal pressure of the mold due to the generation of the combustion gas is controlled so as to be not more than the head pressure. Therefore, blowback of the molten metal from the sprue is reliably prevented.

The present invention provides an evaporative pattern casting process including forming a mold by burying a pattern made of resin foam in casting sand. This process also includes pouring molten metal into the mold and evaporating the pattern with the molten metal and thereby casting a product. In this process, a hollow space for discharging gas is formed on the pattern in the casting sand, except for a portion to which the molten metal is poured last. In addition, the hollow space has an upper end which is positioned at the level of not more than the uppermost portion of the pattern and which is arranged with a filter.

Effects of the Invention

In accordance with the present invention, the casting time during founding is set according to the modulus of the pattern. Therefore, the casting time in the evaporative pattern casting process is accurately set with high precision, whereby a casting product having superior quality is obtained.

In addition, the gate is positioned at the level of the center of gravity of the product or at the level of the vicinity of the center of gravity of the product. Therefore, molten metal at high temperature is filled into the entire area of the pattern without increasing the number of the gates, whereby residue defects are effectively reduced.

Moreover, blowback of the molten metal from the sprue is reliably prevented by an easy method that does not increase the production steps and the costs. Therefore, the casting process is safely performed. In addition, the rate of pouring the molten metal is increased as much as possible while the blowback is prevented. Therefore, the molten metal is rapidly poured, and the temperature of the molten metal that is poured last is maintained high. As a result, a casting product having high quality with little residue is obtained.

Furthermore, the hollow space for discharging combustion gas is provided in the mold and has an upper end at the level of not more than the uppermost portion of the pattern. Therefore, it is not necessary to increase the head pressure by increasing the sprue height, and the casting is performed at minimum head pressure. As a result, the sprue height is reduced as much as possible, whereby increase of the casting production cost is prevented.

EXPLANATION OF REFERENCE NUMERALS

1, 21, 31, and 41 denote a mold, 2, 22, 32, and 42 denote casting sand, 3, 23, 33, and 43 denote a pattern, 4, 24, 34, and 44 denote a gate, 5, 25, 35, and 45 denote a runner, 6, 26, 36, and 46 denote a sprue, 7, 27, and 37 denote a gas discharge passage, 8, 28, 38, and 48 denote a filter, 47 denotes a hollow space, and 210 denotes a casting (product).

BEST MODE FOR CARRYING OUT THE INVENTION

Embodiments relating to the present invention will be described with reference to figures hereinafter.

1. First Embodiment

Figure 1:
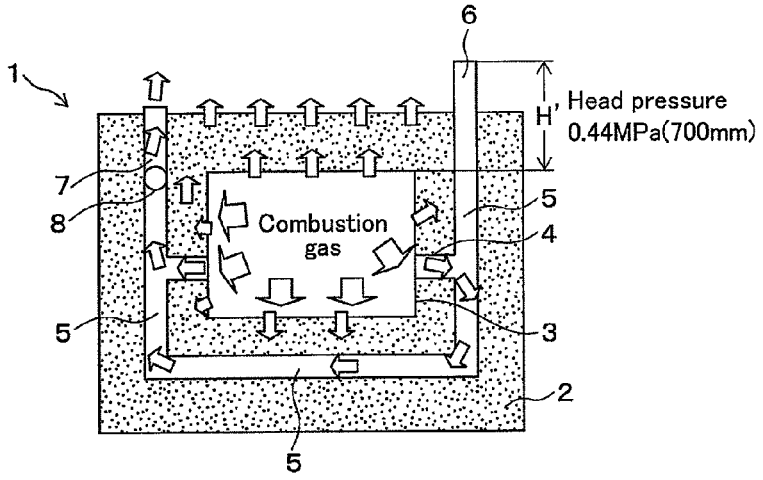
FIG. 1 is a cross section of a mold that schematically shows an evaporative pattern casting process relating to a First Embodiment of the present invention.

FIG. 1 shows a cross section of a mold 1 that schematically shows an evaporative pattern casting process relating to the First Embodiment of the present invention. The mold 1 includes a pattern 3 that is buried in casting sand 2 filled in a mold flask, which is not shown in FIG. 1.

A gate 4 connected to the pattern, and a runner 5 connected to the gate 4, are formed around the pattern 3 in the casting sand 2. The runner 5 is provided with plural openings (two openings in FIG. 1) to an upper surface of the mold 1, and one of the openings (on the right side in FIG. 1) is provided with a sprue 6. The runner 5 on the other opening side is specifically used as a gas discharge passage 7, and the gas discharge passage 7 is arranged with a filter 8 for discharging only combustion gas to the atmosphere outside of the mold 1.

The mold 1 is produced as follows. First, the surface of the pattern 3 is coated with a mold wash and is sufficiently dried. The mold wash is primarily made of graphite and is highly fire resistant. On the other hand, the runner 5 (including the gas discharge passage 7) and the gate 4 are formed to the mold flask by a method of assembling paper tubes, or the like. In addition, the pattern 3 is arranged so as to be supported at an approximately center portion in the mold flask. In this condition, the filter 8 is arranged in the gas discharge passage 7. Then, the casting sand 2 is filled in the mold flask so as to bury the pattern 3, and the sprue 6 is placed.

The casting sand 2 is new sand or used sand of one selected from the group consisting of silica sand primarily made of quartz, zircon sand, chromite sand, synthetic ceramic sand, or the like. A binder and a hardener may be added to the casting sand 2 as needed.

The runner 5 and the gate 4 are formed by using a commercially available product with a diameter of 30 to 70 mm (for example, Quaker Casting Runner Tube manufactured by Kao Co., Ltd.: EG runner CF-30S, CF-50S, CF-70S, etc., which are primarily made of recycled pulp) or the like. As the filter 8, a porous material or the like is used. The porous material is made by mixing an appropriate binder with sand corresponding to silica sand No. 2 and by forming the sand so as to have a thickness of approximately 40 mm. Height H from a pouring surface at the upper surface of the pattern 3 to the sprue 6 is preferably 700 mm, and in this case, the head pressure is approximately 0.044 MPa.

The pattern 3 is made of synthetic resin foam such as foam polystyrene and is formed into a predetermined shape by hand. As the mold wash, for example, Kao-Quaker PC260 manufactured by Kao Co., Ltd., is used. The mold wash is coated on the surface of the pattern so as to have a thickness of 1.5 to 3.5 mm and to have air permeability of approximately 1 per 10 $mm^2$.

Thus, the mold 1 is produced. In this mold 1, when molten metal is poured from the sprue 6, the molten metal goes through the runner 5 and the gate 4 and reaches the pattern 3. Then, the pattern 3 is dissolved by the molten metal and is evaporated, whereby the molten metal is filled in the space at which the pattern 3 existed. That is, the pattern 3 is replaced by the molten metal. When the pattern 3 is combusted by initial pouring of the molten metal, an enormous amount of combustion gas is generated. The combustion gas passes through the filter 8 in the gas discharge passage 7 at the lowermost stream of the runner 5 and is discharged to the atmosphere. A part of the combustion gas passes through the coating of the mold wash formed on the surface of the pattern 3 and then passes through the casting sand 2, thereby being discharged to the atmosphere.

In the present invention, a First Formula for casting time including a modulus was made from the following conventional Second Formula for casting time and from casting data of the past, based on a correlation. In this correlation, when a modulus (pattern volume÷pattern surface area) of a pattern is larger, casting time is longer. The Second Formula is described on page 85 in Casting Handbook, 4th revision, complied by the Japan Foundry Engineering Society, published by Maruzen Co., Ltd.

First Formula $$t=(W/A')/(\rho\cdot a\cdot m^{-b}\cdot\sqrt{2gH}) \quad (1)$$

t: casting time (s)
W: pouring weight (kg)
A': sprue area ($cm^2$)
π: density of molten metal ($g/cm^{-3}$)
a, b: constants m: modulus (pattern volume÷pattern surface area)

g: gravity acceleration

H': height from a sprue to an upper end of a pattern (cm)

Second Formula $$t=W/(\rho\cdot c\cdot A\cdot\sqrt{2gH}) \quad (2)$$

c: flow rate coefficient

A: cross section of gate opening (ingate) with respect to a casting ($cm^2$)

H: effective water head

The conventional Second Formula is useful when the gate area is smaller than the sprue area. In the evaporative pattern casting process, an enormous amount of gas is generated by combustion of the pattern in the mold. Therefore, the gate area must be made to be larger than the sprue area so as to discharge the gas also from the gate. In the conventional Second Formula, the cross section of the gate opening is used as a parameter for the casting time. In contrast, the cross section of the gate opening is substituted with a sprue area in the present invention.

Figure 2:
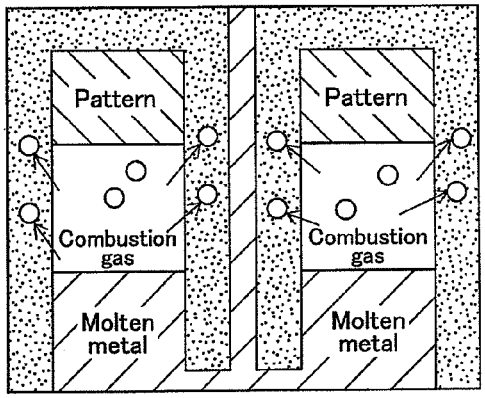
FIG. 2 is a conceptual diagram for illustrating a function of variation in casting time due to the degree of modulus of a pattern and shows a casting model with a relatively small modulus in the First Embodiment.
Figure 3:
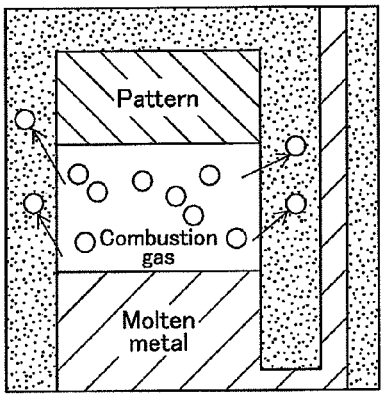
FIG. 3 is a conceptual diagram for illustrating a function of variation in casting time due to the degree of modulus of a pattern and shows a casting model with a relatively large modulus in the First Embodiment.

The function of the casting time, which becomes longer according to the increase in the modulus, will be described with reference to FIGS. 2 and 3 as follows. FIGS. 2 and 3 schematically show casting models. FIG. 2 shows a first casting model in which a pattern has a surface area S, volume V, and a wall thickness w. On the other hand, FIG. 3 shows a second casting model in which a pattern has the same volume and twice the wall thickness and thereby has half the surface area, compared with the pattern in FIG. 2.

In this condition, the modulus and the amount of combustion gas, which passes through the mold wash coated on the pattern surface per unit time were investigated. The amount of gas passing through the mold wash per unit time is proportional to the surface area of the mold wash, whereby a ratio of the amount of gas passing through the mold wash per unit time is as follows.

$$\text{First model: Second model} = a\cdot S : aS/2 \ (a \text{ is constant}) = 2:1 \quad (3)$$

On the other hand, since the modulus is a ratio of volume to surface area, a modulus ratio is as follows.

$$\text{First model: Second model} = V/S : 2V/S = 1:2 \quad (4)$$

The Third Formula and the Fourth Formula described above show that the amount of gas passing through the mold wash per unit time becomes half when the modulus is doubled. That is, when the modulus is increased, the amount of the combustion gas per volume is increased, whereby the internal pressure in the mold is increased. The increase of the internal pressure in the mold makes the casting time longer. Accordingly, in order to calculate the casting time in the evaporative pattern casting process, the modulus of the pattern must be included.

By calculating the casting time in the evaporative pattern casting process as described above, the following additional items relating to the casting are performed.

Casting Defects Estimation at an Earlier Time

By comparing an actual casting time t1 (seconds) and casting time t2 (seconds) that is calculated by the calculating method relating to the present invention, generation of casting defects is estimated at an earlier time. The relationship between t1 and t2 shows the kind of casting defects as follows, for example. In this case, a constant σ is specified such that 3σ is approximately equal to 6.

t1>t2+3σ: misrun, residue defects (pattern remains unevaporized)

t1<t2−3σ: pouring amount shortage, inclusion of mold wash

Accordingly, when there is a great difference between the actual casting time and the calculated casting time, generation of some casting defects on the product is estimated. Thus, if generation of the casting defects is estimated, recasting is rapidly performed before the mold is shaken out. Therefore, production advantages such that time loss of cooling time is reduced are obtained.

Casting Time Parameter for Rheological Analysis of Molten Metal

The casting time calculated by the calculating method relating to the present invention may be used for calculation in rheological analysis of molten metal. In this case, pouring temperature of molten metal and a part, at which molten metal is poured last, are simulated with high accuracy. Therefore, reliability of the results of the simulation is improved.

Practical Example Relating to the First Embodiment

A pattern made of foam polystyrene was formed so as to have an outer shape of 750×800×430 (mm) and to have a modulus of 2.15. Then, the surface of the pattern was coated with a mold wash (60 to 65 Baume) and was dried. Next, a mold having the same structure as in the mold shown in FIG. 1 was constructed, and casting was performed. The casting material was FC300 (flake graphite cast iron), the temperature of molten metal when poured (pouring temperature) was 1380° C., and the pouring weight was 1.2 tons (casting sample No. 1 in Table 1). Similarly, casting was performed with a pattern having a modulus of 1.9 to 2.5 at a pouring weight of 1 to 13 tons, and casting samples Nos. 2 to 6 in Table 1 were obtained. Table 1 shows the casting conditions and calculated casting times.

TABLE 1

| No. | Modulus | Pouring weight W(kg) | Sprue cross section A'($cm^2$) | W/A' | Casting time (s) |
|---|---|---|---|---|---|
| 1 | 2.15 | 1200 | 38.5 | 31 | 25 |
| 2 | 2.41 | 4305 | 77.0 | 56 | 47 |
| 3 | 2.41 | 4455 | 77.0 | 58 | 54 |
| 4 | 2.20 | 5100 | 77.0 | 66 | 54 |
| 5 | 1.94 | 13000 | 153.9 | 84 | 57 |
| 6 | 1.94 | 13000 | 153.9 | 84 | 61 |

Calculating formulas for deriving the First Formula will be described hereinafter. First, the following Fifth Formula was obtained from the Second Formula. The Fifth Formula shows casting time, which does not include a modulus.

Fifth Formula $$t=(W/A')/(\sigma\cdot c'\cdot\sqrt{2gH'}) \quad (5)$$

Then, the casting conditions in Table 1 were substituted in the Fifth Formula, whereby constants C' were obtained. These calculated results are shown in Table 2.

TABLE 2

| No. | Modulus | W/A' | Casting time (s) | C' |
|---|---|---|---|---|
| 1 | 2.15 | 31 | 25 | 0.00050 |
| 2 | 2.41 | 56 | 47 | 0.00047 |
| 3 | 2.41 | 58 | 54 | 0.00043 |
| 4 | 2.20 | 66 | 54 | 0.00049 |
| 5 | 1.94 | 84 | 57 | 0.00059 |
| 6 | 1.94 | 84 | 61 | 0.00055 |

Figure 4:
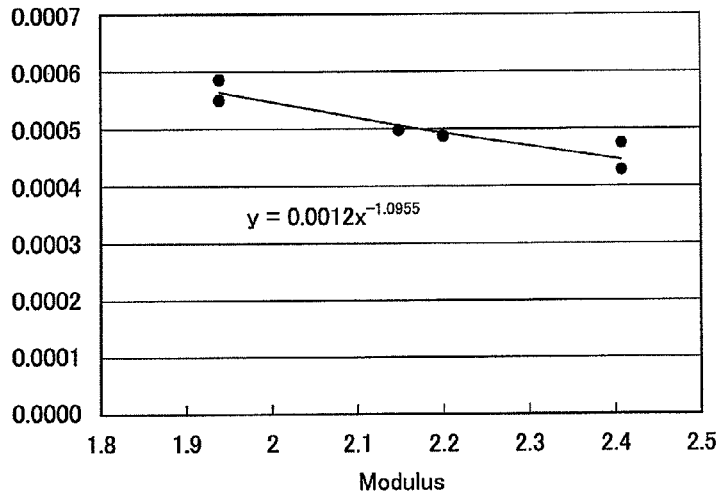
FIG. 4 is a graph showing a relationship between C' (constant) and modulus of a pattern, which is necessary to calculate casting time in a practical example relating to the First Embodiment.

Next, a graph of the value of C' and the modulus of the pattern was made (FIG. 4), and the following approximate formula of the Sixth Formula was obtained. In this case, the constants a=0.0012 and b=1.0995.

$$C=0.0012\ m^{-1.0955} \quad (6)$$

By substituting the approximate formula of the Sixth Formula into the Fifth Formula, the First Formula was obtained. Then, a value of the modulus m=1.8, 2.0, 2.2, and 2.4 was substituted into the First Formula, whereby the graph shown in FIG. 5 was obtained.

Figure 5:
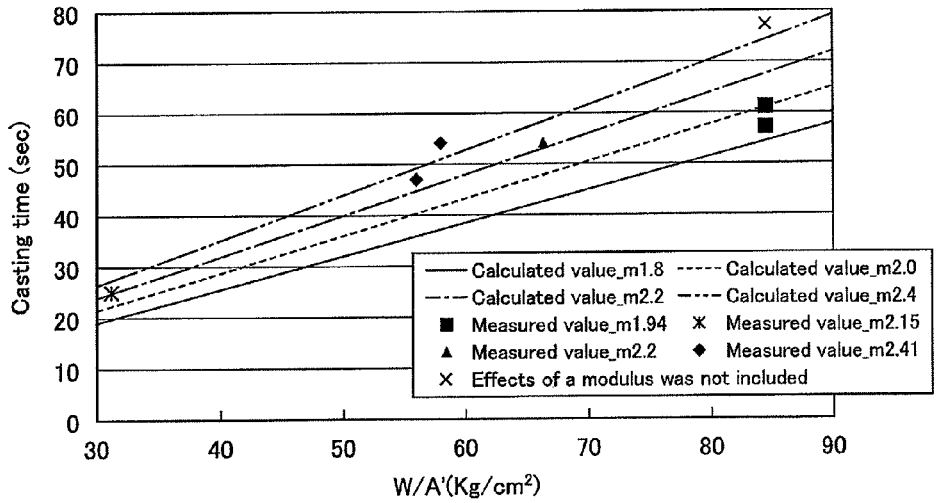
FIG. 5 is a graph showing casting time that is calculated according to a modulus of a pattern in the practical example relating to the First Embodiment.

FIG. 5 shows measured values of actual casting time of the casting samples Nos. 1 to 6 in Table 1. FIG. 5 also shows casting time that was set based only on the Second Formula without including the modulus when W/A' was the same as in the casting samples Nos. 5 and 6 (indicated by a symbol "×"). When the effects of the modulus were not included, the casting time was greater by 18 seconds, and the temperature when the molten metal was poured last was less by approximately 20° C., compared with the case of the present invention. Therefore, according to the present invention, the casting time was appropriately set, and thereby a casting having good quality was reliably obtained.

2. Second Embodiment

Figure 6:
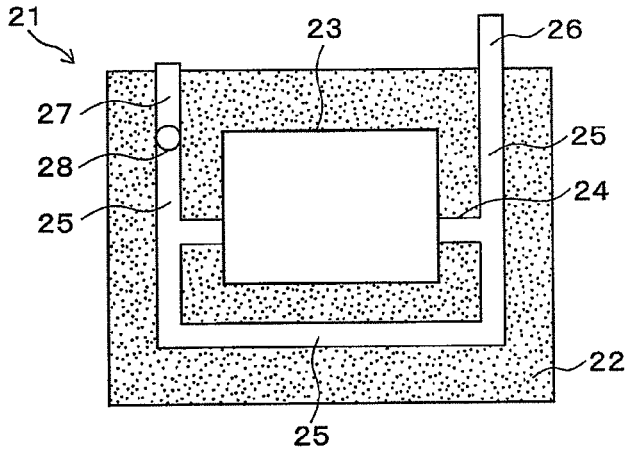
FIG. 6 is a cross section of a mold that schematically shows an evaporative pattern casting process relating to a Second Embodiment of the present invention.

FIG. 6 shows a cross section of a mold 21 that schematically shows an evaporative pattern casting process relating to the Second Embodiment of the present invention. The mold 21 includes a pattern 23 that is buried in casting sand 22 filled in a mold flask, which is not shown in FIG. 6.

A gate 24 connected to the pattern, and a runner 25 connected to the gate 24, are formed around the pattern 23 in the casting sand 22. The runner 25 is provided with plural openings (two openings in FIG. 6) to an upper surface of the mold 21, and one of the openings (on the right side in FIG. 6) is provided with a sprue 26. The runner 25 on the other opening side is specifically used as a gas discharge passage 27, and the gas discharge passage 27 is arranged with a filter 28 for discharging only combustion gas to the atmosphere outside of the mold 21.

The mold 21 is produced as follows. First, the surface of the pattern 23 is coated with a mold wash and is sufficiently dried. The mold wash is primarily made of graphite and is highly fire resistant. On the other hand, the runner 25 (including the gas discharge passage 27) and the gate 24 are formed to the mold flask by a method of assembling paper tubes, or the like. In addition, the pattern 23 is arranged so as to be supported at an approximately center portion in the mold flask. In this condition, the filter 28 is arranged in the gas discharge passage 27. Then, the casting sand 22 is filled in the mold flask so as to bury the pattern 23, and the sprue 26 is placed.

The casting sand 22 is new sand or used sand of one selected from the group consisting of silica sand primarily made of quartz, zircon sand, chromite sand, synthetic ceramic sand, or the like. A binder and a hardener may be added to the casting sand 22 as needed.

The runner 25 and the gate 24 are formed by using a commercially available product with a diameter of 30 to 70 mm (for example, Quaker Casting Runner Tube manufactured by Kao Co., Ltd.: EG runner CF-30S, CF-50S, CF-70S, which are primarily made of recycled pulp) or the like. As the filter 28, a porous material or the like is used. The porous material is made by mixing an appropriate binder with sand corresponding to silica sand No. 2 and by forming the sand so as to have a thickness of approximately 40 mm.

The pattern 23 is made of synthetic resin foam such as foam polystyrene and is formed into a predetermined shape by hand. As the mold wash, for example, Kao-Quaker PC260 manufactured by Kao Co., Ltd., is used. The mold wash is coated on the surface of the pattern so as to have a thickness of 1.5 to 3.5 mm and to have air permeability of approximately 1 per 10 $mm^2$.

Thus, the mold 21 is produced. In this mold 21, when molten metal is poured from the sprue 26, the molten metal goes through the runner 25 and the gate 24 and reaches the pattern 23. Then, the pattern 23 is dissolved by the molten metal and is evaporated, whereby the molten metal is filled in the space at which the pattern 23 existed. That is, the pattern 23 is replaced by the molten metal. When the pattern 23 is combusted by initial pouring of the molten metal, an enormous amount of combustion gas is generated. The combustion gas passes through the filter 28 in the gas discharge passage 27 at the lowermost stream of the runner 25 and is discharged to the atmosphere. A part of the combustion gas passes through the coating of the mold wash formed on the surface of the pattern 23 and then passes through the casting sand 22, thereby being discharged to the atmosphere.

In the mold 21 in the Second Embodiment, the height of the gate 24 in the casting sand 22 is set so as to satisfy the following conditions.

(a) Height at the level of center of gravity of a casting product (b) Height at the level of from center of gravity of a casting product down to 120 mm (c) When center of gravity of a casting product is positioned in a range from a lower end of the product up to 440 mm, the height of the gate is set at the level of the range so as to be higher than the center of gravity of the product.

In the present invention, the condition (a) is the best mode. However, in practical production, there are cases in which the gate cannot be set at the level of the center of gravity of a product due to the design. In this case, the condition (b) or (c) is used. That is, the height of the gate in the present invention is most preferably at the level of the center of gravity of a product. Nevertheless, when the condition (a) is difficult to satisfy, the height of the gate may be set at an upper or lower position in the vicinity of the center of gravity of the product.

Figure 7:
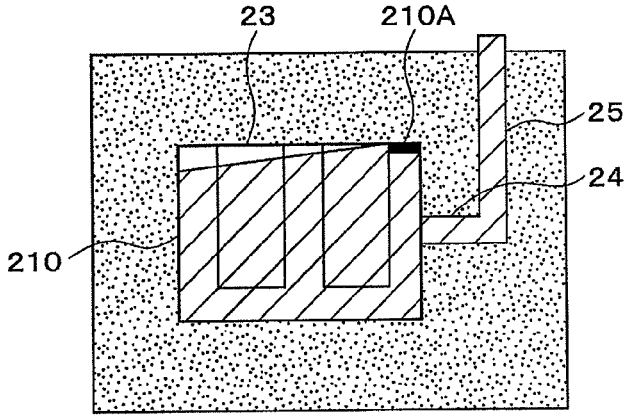
FIG. 7 is a cross section showing a condition of founding a casting (product) having an essential portion at a part of an upper surface in a mold (side gate type) relating to the Second Embodiment.

Advantages of the present invention in the following case will be described with reference to FIGS. 7 and 8 hereinafter. In this case, a casting has an essential portion at an upper surface. The hatched portions are founded portions by filling molten metal in FIGS. 7 and 8. FIG. 7 shows a condition of founding a casting (product) 210 having an essential portion 210A at a part of an upper surface by the method of the present invention. The essential portion 210A is a portion which must not have casting defects such as residue defects and which must be casted fine by filling molten metal sufficiently. As shown in FIG. 7, the gate 24 is arranged at a side of the casting 210 (side gate type), and the essential portion is positioned immediately above the gate 24. When the gate 24 is positioned so as to satisfy one of the conditions (a) to (c), the molten metal is preferentially filled into the essential portion 210A. Therefore, residue defects do not easily occur at the essential portion 210A.

Figure 8:
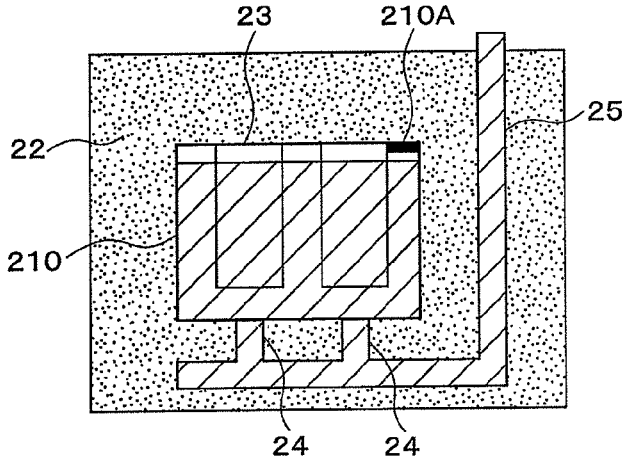
FIG. 8 is a cross section showing a condition of founding a casting (product) having an essential portion at a part of an upper surface in a mold (bottom gate type) that is outside the scope of the present invention.

On the other hand, FIG. 8 shows a mold of a bottom gate type in which the gate 24 is arranged at the bottom surface of the casting 210. In this case, the molten metal is filled into almost entirety of the upper surface of the pattern at the same time, and residue defects easily occur on the entirety of the upper surface. Therefore, residue defects tend to exist at the essential portion 210A.

The gate height affects the filling condition of the molten metal into the pattern area that is to be replaced with a casting. If the gate is too high, the residue defects tend to occur on the bottom surface side of the casting. On the other hand, if the gate is too low, the residue defects tend to occur on the upper surface side of the casting. The present invention overcomes this problem, and the upper limit and the lower limit of the gate height are set according to the condition (b) or (c).

The upper limit and the lower limit of the gate height are expressed by the following Seventh Formula in the following conditions.

H(upper limit): upper limit of gate height from a bottom surface of a casting (mm)

H(lower limit): lower limit of gate height from a bottom surface of a casting (mm)

Hgate: gate height from a bottom surface of a casting (mm)

$$H(\text{upper limit}) \geq H\text{gate} \geq H(\text{lower limit}) \quad (7)$$

When the condition represented by the Seventh Formula is satisfied, molten metal at high temperature is filled into the entirety of the casting product, whereby residue defects are decreased. In this case, the upper limit of gate height: H(upper limit) and the lower limit of gate height: H(lower limit) are calculated from casting data as follows.

The following conditions are set.

Ha: height of a bottom surface (lower end) of a casting (mm)

Hb: height of center of gravity of a casting (mm)

Hc: height of an upper surface (upper end) of a casting (mm)

a, b: constants (when the pouring temperature is 1380° C. and a handmade pattern primarily made of foam polystyrene with foam expansion ratio of 50 is used, a=440 and b=120)

In this case, when Hb<440, $$H(\text{upper limit}) = Ha + a \quad (8)$$

$$H(\text{lower limit}) = Hb - b \quad (9)$$

Figure 9:
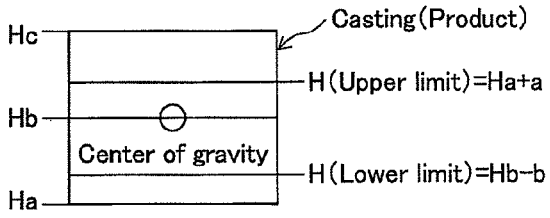
FIG. 9 schematically shows positions for setting a gate height in the Second Embodiment of the present invention.

The images of Ha, Hb, He, "H(upper limit)=Ha+a", and "H(lower limit)=Hb−b" are shown in FIG. 9.

Figure 10:
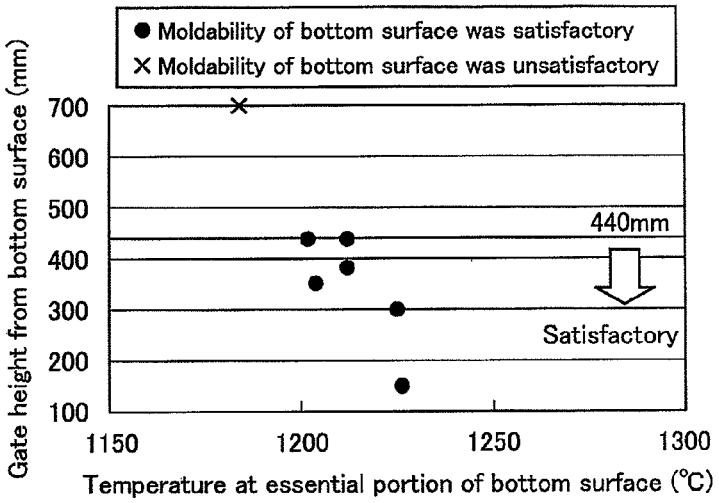
FIG. 10 is a graph showing a relationship between molten metal temperature at an essential portion of a bottom surface of a casting and gate height from the bottom surface of the casting.
Figure 11:
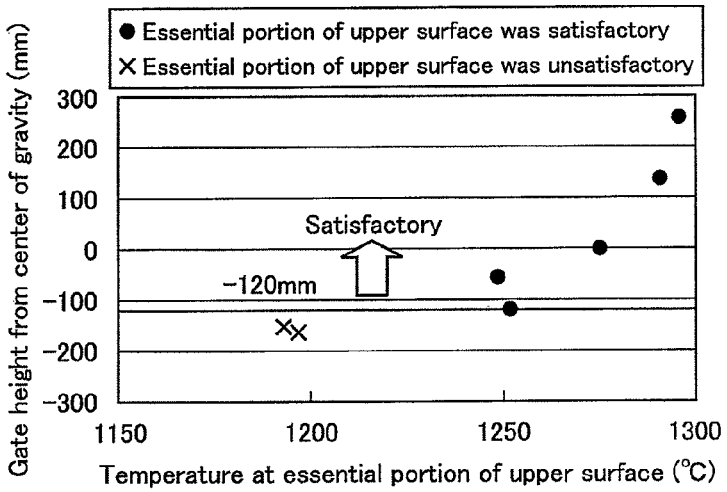
FIG. 11 is a graph showing a relationship between molten metal temperature at an essential portion of an upper surface of a casting and gate height from the center of gravity of the casting.

The constants "a" and "b" are obtained from Table 3 and the graphs in FIGS. 10 and 11. Table 3 and the graphs are casting data of results of investigating moldabilites of the bottom surface and the upper surface of the casting samples Nos. 1 to 7 in which the gate height was changed. Each of the bottom surface and the upper surface of the casting had an essential portion.

TABLE 3

| | Hgate (mm) | Hb (mm) | Hgate − Hb (mm) | Moldability of bottom surface of casting | Moldability of upper surface of casting |
|---|---|---|---|---|---|
| 1 | 440 | 306 | 134 | ○ | ○ |
| 2 | 296 | 296 | 0 | ○ | ○ |
| 3 | 440 | 500 | −60 | ○ | ○ |
| 4 | 380 | 500 | −120 | ○ | ○ |
| 5 | 350 | 501 | −151 | ○ | x |
| 6 | 145 | 306 | −161 | ○ | x |
| 7 | 695 | 440 | 255 | x | ○ |

As shown in Table 3, the moldability of the bottom surface of the casting was superior until the Hgate (gate height) was up to 440 mm. FIG. 10 is a graph showing a relationship between the molten metal temperature at the essential portion of the bottom surface of the casting and the gate height from the bottom surface of the casting. This graph clearly shows that the essential portion of the bottom surface was casted without generating residue defects when the gate height from the bottom surface of the casting was not more than 440 mm. Accordingly, the value of "a" is set to be 440.

As shown in Table 3, in regard to the moldability of the upper surface of the casting, residue defects were generated when the value of "Hgate−Hb" (gate height from the center of gravity of the casting) was not more than −120 mm. FIG. 11 shows a graph showing a relationship between the molten metal temperature at the essential portion of the upper surface of the casting and the gate height from the center of gravity of the casting. This graph clearly shows that the essential portion at the upper surface was casted without generating residue defects when the gate height from the center of gravity of the casting was not more than −120 mm. Accordingly, the value of "b" is set to be 120.

Thus, by setting the gate height in the casting sand so as to satisfy one of the conditions (a) to (c), the evaporative pattern casting process is performed such that the moldabilities of the bottom surface and the upper surface of the casting (product) are good. In particular, in this process, residue defects do not easily occur at the essential portion of the upper surface. In Table 3, the casting samples Nos. 1 to 4 are examples of the present invention and the casting samples Nos. 5 to 7 are comparative examples that are outside the scope of the present invention.

Practical Example Relating to the Second Embodiment

A pattern made of foam polystyrene was formed so as to have an outer shape of 750×800×430 (mm). Then, the surface of the pattern was coated with a mold wash (60 to 65 Baume) and was dried. Next, a mold having the same structure as in the mold shown in FIG. 6 was constructed, and casting was performed. The gate height in the casting sand of the mold was 435 mm from the bottom surface of the pattern according to the center of gravity of the casting. In this case, the upper limit of the gate height: H(upper limit) was 440 mm, the lower limit of the gate height: H(lower limit) was 380.7 mm. The casting material was FC300 (flake graphite cast iron), the temperature of molten metal when poured (pouring temperature) was 1365° C., and the pouring weight was 13 tons. After the casting, casting defects such as residue defects were not generated on the bottom surface and the upper surface of the casting, and a superior product was obtained.

3. Third Embodiment

Figure 12:
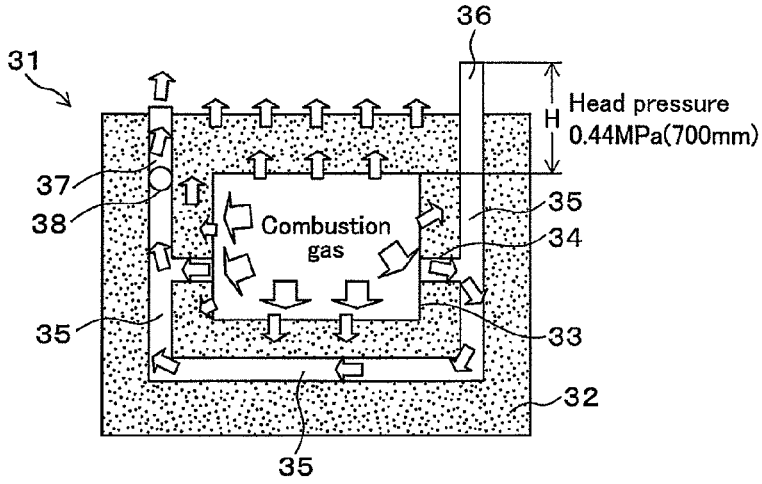
FIG. 12 is a cross section of a mold that schematically shows an evaporative pattern casting process relating to a Third Embodiment of the present invention.

FIG. 12 shows a cross section of a mold 31 that schematically shows an evaporative pattern casting process relating to the Third Embodiment of the present invention. The mold 31 includes a pattern 33 that is buried in casting sand 32 filled in a mold flask, which is not shown in FIG. 12.

A gate 34 connected to the pattern, and a runner 35 connected to the gate 34, are formed around the pattern 33 in the casting sand 32. The runner 35 is provided with plural openings (two openings in FIG. 12) to an upper surface of the mold 31, and one of the openings (on the right side in FIG. 12) is provided with a sprue 36. The runner 35 on the other opening side is specifically used as a gas discharge passage 37, and the gas discharge passage 37 is arranged with a filter 38 for discharging only combustion gas to the atmosphere outside of the mold 31.

The mold 31 is produced as follows. First, the surface of the pattern 33 is coated with a mold wash and is sufficiently dried. The mold wash is primarily made of graphite and is highly fire resistant. On the other hand, the runner 35 (including the gas discharge passage 37) and the gate 34 are formed in the mold flask by a method of assembling paper tubes, or the like. In addition, the pattern 33 is arranged so as to be supported at an approximately center portion in the mold flask. In this condition, the filter 38 is arranged in the gas discharge passage 37. Then, the casting sand 32 is filled into the mold flask so as to bury the pattern 33, and the sprue 36 is placed.

The casting sand 32 is new sand or used sand of one selected from the group consisting of silica sand primarily made of quartz, zircon sand, chromite sand, synthetic ceramic sand, or the like. A binder and a hardener may be added to the casting sand 32 as needed.

The runner 35 and the gate 34 are formed by using a commercially available product with a diameter of 30 to 70 mm (for example, Quaker Casting Runner Tube manufactured by Kao Co., Ltd.: EG runner CF-30S, CF-50S, CF-70S, which are primarily made of recycled pulp) or the like. As the filter 38, a porous material or the like is used. The porous material is made by mixing an appropriate binder with sand corresponding to silica sand No. 2 and by forming the sand.

The pattern 33 is made of synthetic resin foam such as foam polystyrene and is formed into a predetermined shape by hand. As the mold wash, for example, Kao-Quaker PC260 manufactured by Kao Co., Ltd., is used. The mold wash is coated on the surface of the pattern so as to have a thickness of 1.5 to 3.5 mm and to have air permeability of approximately 1 per 10 $mm^2$.

Thus, the mold 31 is produced. In this mold 31, when molten metal is poured from the sprue 36, the molten metal goes through the runner 35 and the gate 34 and reaches the pattern 33. Then, the pattern 33 is dissolved by the molten metal and is evaporated, whereby the molten metal is filled in the space at which the pattern 33 existed. That is, the pattern 33 is replaced by the molten metal. When the pattern 33 is combusted by initial pouring of the molten metal, an enormous amount of combustion gas is generated. The combustion gas passes through the filter 38 in the gas discharge passage 37 at the lowermost stream of the runner 35 and is discharged to the atmosphere. A part of the combustion gas passes through the coating of the mold wash formed on the surface of the pattern 33 and then passes through the casting sand 32, thereby being discharged to the atmosphere.

Figure 13:
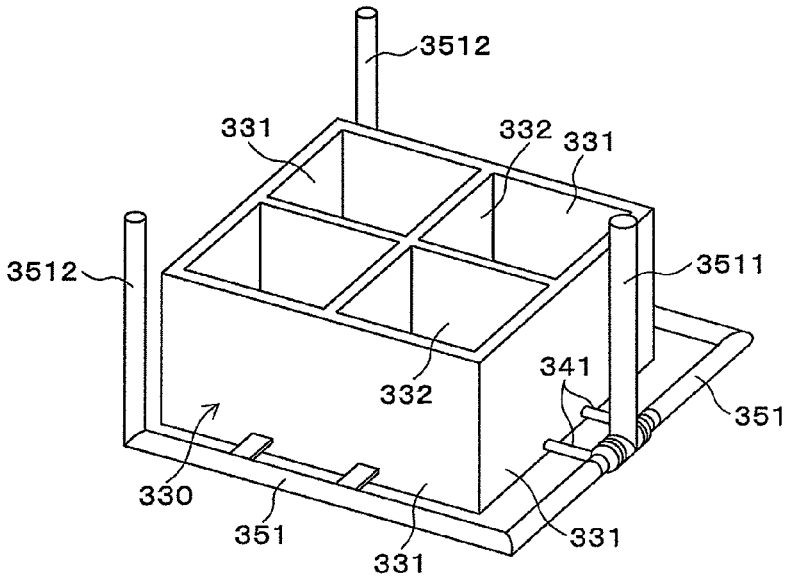
FIG. 13 is a perspective view of an example of a casting product obtained in the Third Embodiment.

FIG. 13 shows an as-cast casting product 330 that was taken out by shaking out the casting sand after it was casted in the above mold. The product 330 is a boxlike object with rectangular parallelepiped shape having an upper opening and is formed with a partition wall 332 at an inside surrounded by a bottom and a side wall 331. The partition wall 332 divides the inside space into four sections. The side wall 331 is connected with gate portions 341 and runner portions 351, which were casted. In this case, two runner portions 3512 are on the side of discharging gas, and one runner portion 3511 is on the side of the sprue. The casted gate portions 341 and the runner portions 351 are cut off from the product 330, and the product 330 is subjected to necessary steps and is then provided for practical use.

In the mold 31 of the Third Embodiment, combustion gas is generated by combustion and evaporation of the pattern 33 and increases the internal pressure. The internal pressure is controlled so as to be not more than the head pressure by adjusting the gas passing sectional area of the filter 38 according to the modulus (product volume÷produce surface area) of the product (pattern 33). As a result, blowback of the molten metal from the sprue 36 is prevented.

That is, the internal pressure of the mold 31 depends on the sectional area for allowing the combustion gas to pass through the filter 38 in the gas discharge passage 37. The internal pressure also depends on the air permeability of the mold 31 and the coating of the mold wash and depends on the modulus. In view of this, in the Third Embodiment, the conditions of the mold 31 are fixed, and the gas passing sectional area of the filter 38 is set according to the modulus of only the casting. Thus, the internal pressure of the mold 31 is controlled so as to be not more than the head pressure. The degree of the head pressure depends on the height H from the pouring surface at the upper surface of the pattern 33 to the sprue as shown in FIG. 12. For example, when the height H is 700 mm, the head pressure is 0.044 MPa.

As described in the following practical example, a relationship of the gas passing sectional area of the filter, the modulus, and the blowback of the molten metal from the sprue, was investigated by actually performing casting.

Practical Example Relating to the Third Embodiment

Figure 14:
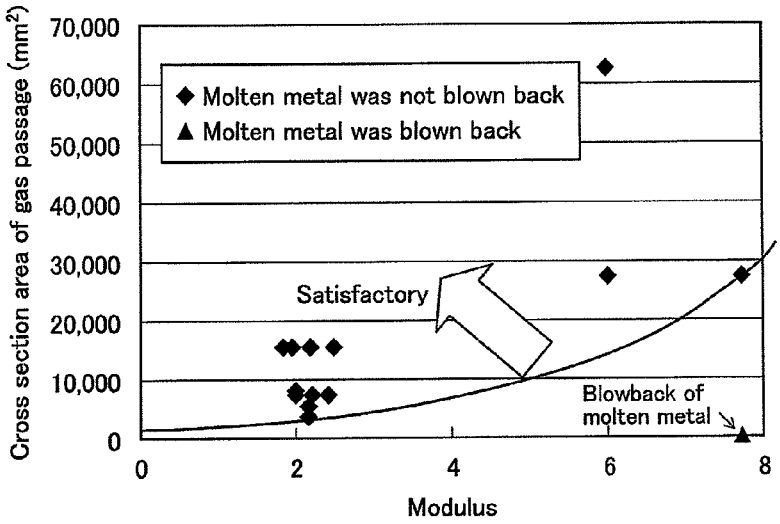
FIG. 14 is a graph showing a relationship between modulus and gas passing sectional area of a filter in a casting product obtained in a practical example relating to the Third Embodiment.

Occurrence of blowback of the molten metal from the sprue was investigated by using casting samples Nos. 1 to 16. Each of the casting samples Nos. 1 to 16 had product weight and a modulus shown in Table 4 and was casted in a mold with a filter having a gas passing sectional area shown in Table 4. The mold had the same structure as in the mold shown in FIG. 12, and a pattern was made of foam polystyrene and was formed into an outer shape of 750×800×430 (mm). The surface of the pattern was coated with a mold wash (60 to 65 Baume) and was dried. Then, the mold was constructed, and casting was performed. The casting material was FC300 (flake graphite cast iron), the temperature of molten metal when poured (pouring temperature) was 1380° C., and the head pressure was 0.044 MPa, which were fixed conditions. The relationship between the modulus and the gas passing sectional area is shown in FIG. 14. In addition, occurrence of blowback (x indicates that the blowback occurred, and ○ indicates that the blowback did not occur) is shown in Table 4.

TABLE 4

| No. | Product weight (kg) | Modulus | Gas passing sectional area ($mm^2$) | | $1533.8e^{a*M}$ | Occurrence of blowing back |
|---|---|---|---|---|---|---|
| 1 | 720 | 2.15 | 3927 | > | 3413 | ○ |
| 2 | 1000 | 7.75 | 0 | < | 27406 | X |
| 3 | 1000 | 7.75 | 27489 | > | 27406 | ○ |
| 4 | 1640 | 5.98 | 62361 | > | 14187 | ○ |
| 5 | 1640 | 5.98 | 27489 | > | 14187 | ○ |
| 6 | 1915 | 1.97 | 7854 | > | 3192 | ○ |
| 7 | 2100 | 1.97 | 7697 | > | 3192 | ○ |
| 8 | 4082 | 2.41 | 7697 | > | 3759 | ○ |
| 9 | 4208 | 2.2 | 7697 | > | 3477 | ○ |
| 10 | 4820 | 2.22 | 7697 | > | 3503 | ○ |
| 11 | 5966 | 2.47 | 15394 | > | 3844 | ○ |
| 12 | 6880 | 2.17 | 15394 | > | 3438 | ○ |
| 13 | 7020 | 1.85 | 15394 | > | 3052 | ○ |
| 14 | 7400 | 2.47 | 15394 | > | 3844 | ○ |
| 15 | 10676 | 1.94 | 15394 | > | 3156 | ○ |

In this practical example (head pressure was 0.044 MPa), the following Tenth Formula is obtained in view of FIG. 14.

$$S \geq 1533.8e^{a \cdot M} \quad (10)$$

S: gas passing sectional area of filter ($mm^2$)

M: modulus of product a: constant (differs by the casting conditions, "a" is 0.3724 in the Third Embodiment)

Then, in view of the Tenth Formula and the air permeability of the filter, the following Eleventh Formula is derived.

$$S \geq 10^7 \cdot e^{a \cdot M}/P \quad (11)$$

P: air permeability (6550 in the Third Embodiment)

By using the Eleventh Formula, the gas passing sectional area of the filter is set to a value according to the modulus and the air permeability of the filter so that the blowback does not occur.

Thus, by adjusting the gas passing sectional area of the filter according to the modulus of the product (pattern), increase of the internal pressure due to the generation of the combustion gas is constantly controlled so as to not be more than the head pressure. Accordingly, the blowback of the molten metal from the sprue is reliably prevented. This method does not need a step of forming a through hole on a pattern as in the conventional technique, and it is simple, and it does not increase the production steps. Moreover, it is not required to increase the head pressure, whereby the yield ratio is maintained, and increase of the production cost is prevented.

Furthermore, the pouring rate may be increased to be as fast as possible without blowback occurring. Therefore, the molten metal is rapidly poured, and the temperature when the molten metal is poured last is maintained high, whereby a casting product having high quality with little residue is obtained.

4. Fourth Embodiment

Figure 15:
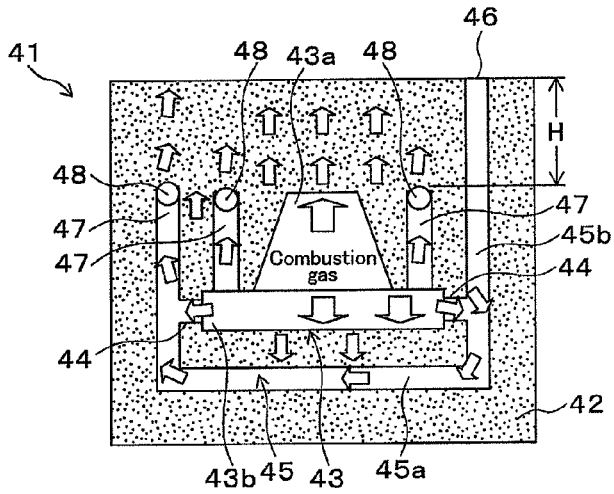
FIG. 15 is a cross section of a mold that schematically shows an evaporative pattern casting process relating to a Fourth Embodiment of the present invention.

FIG. 15 shows a cross section of a mold 41 that schematically shows an evaporative pattern casting process relating to the Fourth Embodiment of the present invention. The mold 41 includes a pattern 43 that is buried in casting sand 42 filled in a mold flask, which is not shown in FIG. 15.

The pattern 43 is a cylindrical member with a hat-shaped cross section and is formed with a flange portion 43*b* under a top portion 43*a* in trapezoidal shape. Gates 44 connected to the flange portion 43*b* of the pattern 43, and a runner 45 connected to the gate 44, are formed in the casting sand 42. The runner 45 has a lower runner 45*a* and a vertical runner 45*b*. The lower runner 45*a* connects the gates 44 under the pattern 43. The vertical runner 45*b* upwardly extends vertically from one of the gates 44 (on the right side in FIG. 15) and opens at an upper surface of the mold 41. The opening of the vertical runner 45*b* is provided as a sprue 46.

Plural hollow spaces 47 for discharging combustion gas are formed and are confined in the casting sand 42. These hollow spaces 47 extend in the vertical direction. Some of the hollow spaces 47 extend upwardly from the flange portion 43*b* of the pattern 43. The other hollow space 47 extends upwardly from the other gate 44 (on the left side in FIG. 15) that is not connected with the vertical runner 45*b*. Each of the hollow spaces 47 has an upper end that is positioned so as to correspond to an upper end surface of the top portion 43*a* of the uppermost portion of the pattern 43. The upper end of each of the hollow spaces 47 is arranged with a filter 48 for discharging only combustion gas generated in founding, through the casting sand 42 to the atmosphere outside of the mold 41.

The mold 41 is produced as follows. First, the surface of the pattern 43 is coated with a mold wash and is sufficiently dried. The mold wash is primarily made of graphite and is highly fire resistant. On the other hand, the runner 45, the gates 44, and the hollow spaces 47 are formed in the mold flask by a method of assembling paper tubes, or the like. In addition, the pattern 43 is arranged so as to be supported at an approximately center portion in the mold flask. In this condition, the filters 48 are arranged in the hollow spaces 47. Then, the casting sand 42 is filled into the mold flask so as to bury the pattern 43, and the sprue 46 is placed.

The casting sand 42 is new sand or used sand of one selected from the group consisting of silica sand primarily made of quartz, zircon sand, chromite sand, synthetic ceramic sand, or the like. A binder and a hardener may be added to the casting sand 42 as needed.

The runner 45, the gates 44, and the hollow spaces 47 are formed by using a commercially available product with a diameter of 30 to 70 mm or the like. For example, a Quaker Casting Runner Tube manufactured by Kao Co., Ltd.: EG runner CF-30S, CF-50S, CF-70S, which are primarily made of recycled pulp, may be used. As the filter 48, a porous material or the like is used. The porous material is made by mixing an appropriate binder with sand corresponding to silica sand No. 2 and by forming the sand so as to have a thickness of approximately 40 mm.

The pattern 43 is made of synthetic resin foam such as foam polystyrene and is formed by hand. As the mold wash, for example, Kao-Quaker PC260 manufactured by Kao Co., Ltd., is used. The mold wash is coated on the surface of the pattern so as to have a thickness of 1.5 to 3.5 mm and to have air permeability of approximately 1 per 10 $mm^2$.

Thus, the mold 41 is produced. In this mold 41, when molten metal is poured from the sprue 46, the molten metal goes through the runner 45 and the gates 44 and reaches the pattern 43. Then, the pattern 43 is dissolved by the molten metal and is evaporated, whereby the molten metal is filled in the space at which the pattern 43 existed. That is, the pattern 43 is replaced by the molten metal. When the pattern 43 is combusted by initial pouring of the molten metal, an enormous amount of combustion gas is generated. The combustion gas enters the hollow spaces 47 and passes through the filters 48 arranged at the upper ends of the hollow spaces 47, and then passes through the casting sand 42, thereby being discharged to the atmosphere. A part of the combustion gas passes through the coating of the mold wash formed on the surface of the pattern 43 and then passes through the casting sand 42 and is discharged to the atmosphere. The large arrows within the mold 41 in FIG. 15 show flow of the combustion gas that is discharged to the outside of the mold 41 as described above.

In the mold 41, combustion gas is generated by combustion and evaporation of the pattern 43 and increases the internal pressure. The combustion gas is led to the plural hollow spaces 47 and passes through the filter 48 or passes through the coating of the mold wash and is discharged to the casting sand 42. Thus, the internal pressure is controlled so as not to exceed the head pressure. The head pressure depends on the height H from the pouring surface corresponding to the uppermost portion (the upper end surface of the top portion 43*a*) of the pattern 43 to the sprue 46. For example, when the height H is 700 mm, the head pressure is 0.044 MPa.

The internal pressure is controlled by adjusting the gas passing sectional areas of the filters 48 arranged at the upper ends of the hollow spaces 47. In this case, the gas passing sectional area of the filter 48 is selected so as to be at least (for example, approximately eight times) larger than the cross section of the hollow space 47 when the hollow space 47 is opened to the atmosphere.

According to the Fourth Embodiment, the upper ends of the hollow spaces 47 for discharging the combustion gas are provided in the mold 41 at positions corresponding to the upper end of the top portion 43*a* of the uppermost portion of the pattern 43. Therefore, even when the head pressure is not increased by heightening the sprue 46, the combustion gas is sufficiently led to the hollow spaces 47. Accordingly, the height of the sprue 46 is made as low as possible, and the casting is performed at minimum head pressure. As a result, the height of the entirety of the mold and the amount of the casting sand are decreased, whereby the production cost is decreased.

Since the combustion gas is led to the hollow spaces 47 confined in the mold 41, the molten metal does not pass through the filters 48 and is not blown out to the outside of the mold 41. Therefore, the casting is performed safely. The hollow spaces 47 do not have openings at the upper surface of the mold 41. Therefore, when the casting is performed by putting a weight on the upper surface of the mold 41, degree of freedoms of the shape and the layout of the weight is large.

In this embodiment, the upper end of the hollow space is arranged so as to correspond to the uppermost portion of the pattern. However, in the present invention, the upper end of the hollow space may be arranged so as to correspond to the uppermost portion of the pattern or so as to be lower than that. Therefore, the position of the upper end of the hollow space is not limited to the position in this embodiment.

Practical Example Relating to the Fourth Embodiment

Casting was performed by using a mold having the same structure as in the mold shown in FIG. 15. That is, a pattern made of foam polystyrene was formed so as to have a bottom surface of the flange portion with a diameter of 1090 mm, an upper surface of the top portion with a diameter of 760 mm, a wall thickness of 150 mm, and a modulus (volume÷surface area) of 6. The surface of the pattern was coated with a mold wash (60 to 65 Baume) and was dried. Then, the mold was constructed, and casting was performed. Plural hollow spaces were formed in the mold so as to connect with the pattern, and an upper end of each of the hollow spaces was made so as to correspond to the uppermost portion of the pattern. The upper end of each of the hollow spaces was arranged with a filter, and the total of the gas passing sectional areas of the filters was 62000 $mm^2$.

The casting material was FC300 (flake graphite cast iron), the temperature of the molten metal in pouring (pouring temperature) was 1380° C., the pouring time was 37 seconds, and the pouring weight was 2.2 tons. The molten metal was not blown out during founding, and a casting having a good quality was obtained.

The invention claimed is:

1. An evaporative pattern casting process, comprising the steps of:

forming a mold by burying a pattern made of resin foam in casting sand;

pouring molten metal into the mold; and evaporating the pattern with the molten metal and thereby casting a product, wherein casting time during founding is set longer as a modulus (pattern volume÷pattern surface area) of the pattern is larger, wherein the pattern volume is equivalent to the volume of the product which does not include a gate, a runner, a sprue, and a gas discharge passage, and the pattern surface area is equivalent to the surface area of the product which does not include a gate, a runner, a sprue, and a gas discharge passage, wherein the casting time is calculated from the following First Formula, wherein the pattern volume is equivalent to the volume of the product which does not include a gate, a runner, a sprue, and a gas discharge passage, and the pattern surface area is equivalent to the surface area of the product which does not include a gate, a runner, a sprue, and a gas discharge passage, First Formula $$t=(W/A')/(\rho\cdot a\cdot m^{-b}\cdot\sqrt{2gH'}) \quad (1)$$

t: casting time (5),

W: pouring weight (kg),

A': sprue area ($cm^2$),

ρ: density of molten metal ($q/cm^{-3}$), a, b: constants, m: modulus (pattern volume÷pattern surface area), g: gravity acceleration, H': height from a sprue to an upper end of a pattern (cm).

2. The evaporative pattern casting process according to claim 1, further comprising estimating existence of casting defects based on a difference between the casting time calculated from the First Formula and casting time during practical founding.

3. The evaporative pattern casting process according to claim 1, further comprising performing a casting simulation based on the casting time calculated from the First Formula.

* * * * *